United States Patent [19]

Sato et al.

[11] 4,183,818

[45] Jan. 15, 1980

[54] COLOR ELECTROPHOTOGRAPHIC LIQUID DEVELOPER OF COLORED PARTICLES AND ZINC OXIDE

[75] Inventors: Masamichi Sato; Hajime Miyazuka, both of Asaka, Japan

[73] Assignee: Xerox Corporation, Stamford, Conn.

[21] Appl. No.: 523,613

[22] Filed: Nov. 13, 1974

Related U.S. Application Data

[63] Continuation of Ser. No. 887,980, Dec. 24, 1969, abandoned.

[30] Foreign Application Priority Data

Dec. 28, 1968 [JP] Japan ..... 43-44980

[51] Int. Cl.[2] ..... G03G 9/00; G03G 5/12

[52] U.S. Cl. ..... 430/115; 430/45

[58] Field of Search ..... 252/62.1; 96/1.2

[56] References Cited

U.S. PATENT DOCUMENTS

| | | | |
|---|---|---|---|
| 3,079,272 | 2/1963 | Greig | 252/62.1 |
| 3,150,976 | 9/1964 | Johnson | 96/1 |
| 3,220,830 | 11/1965 | Kashiwabara | 96/1 |
| 3,293,183 | 12/1966 | Matkan | 252/62.1 |
| 3,403,023 | 9/1968 | Carrington et al. | 96/1.7 |
| 3,703,370 | 11/1972 | Sugerman et al. | 252/62.1 |

*Primary Examiner*—Jack P. Brammer

[57] ABSTRACT

Reproduction of a multicolor original is obtained in an electrophotographic process with multiple development employing a liquid developer comprising an insulating liquid and suspended therein photoconductive particles and colored toner particles. Prior to the second and subsequent development steps, the imaging surface is contacted with a toner free insulating liquid.

1 Claim, 6 Drawing Figures

COLOR ELECTROPHOTOGRAPHIC LIQUID DEVELOPER OF COLORED PARTICLES AND ZINC OXIDE

This application is a continuation application of Ser. No. 887,980, filed on Dec. 24, 1969, now abandoned.

BACKGROUND OF THE INVENTION

This invention relates to imaging systems and more particularly to liquid development systems and liquid developers for use in color reproduction utilizing multiple development.

Color electrophotography with multiple development is capable of producing color reproductions by the following exemplary procedures. A suitable photoconductor such as substantially white zinc oxide photosensitive paper, Electrofax paper for example, is electrostatically uniformly charged in the dark and then exposed through a green filter to an imagewise projection of a color image to form an electrostatic latent image on the photoconductor. The electrostatic latent image is then developed with magenta colored toner to form a magenta colored image corresponding to said electrostatic latent image. The zinc oxide photosensitive paper is again electrostatically uniformly charged in the dark and then exposed through a red filter to an imagewise projection of a colored image in register with said magenta developed image to form a second electrostatic latent image, which second image is developed with cyan colored toner. Similarly, the zinc oxide photosensitive paper is again electrostatically uniformly charged in the dark and then exposed through a blue filter to an imagewise projection of a colored image in register with said magenta and cyan developed images to form a third electrostatic latent image, which is then developed with yellow toner to complete a reproduced color image.

The sequence of exposures through colored filters in this multiple development process may be performed in any suitable sequence other than the green, red and blue sequence recited above. A significant drawback of this multiple development process is that after the formation of the image of the first color and during the second imaging sequence consisting of uniformly charging and imagewise exposing followed by development with tonor of the second color, the zinc oxide photosensitive paper is apt to be electrostatically charged more strongly in the portion where said first colored image is formed in comparison with the other portion where such image does not exist. In addition, the portion of the zinc oxide paper where the first colored image is formed is apt to retain charge in nonimage areas when imagewise exposed to a light pattern which is capable of neutralizing the electrostatic charge in the latter portion. This retained potential, which usually ranges from several volts to several tens of volts, arises from the fact that the ion absorbed by the toner during charging is not neutralized during the imagewise exposure to light. Since the toner usually consists of electrically insulating material the neutralization of the ion for example, held by the toner layer, for material the corona ion generated by corona discharge is hindered. Electroconductive toner cannot be employed in electrophotography with multiple development since the portion of the photoconductor having such toner on its surface during the second and third imaging sequences cannot bear electrostatic charge.

Furthermore, when the electrostatic charge on the first toner layer is not completely neutralized, the toner of second color tends to be improperly deposited onto the first toner layer, giving rise to impure color formation. Similar difficulties also arise in the development with the toner of the third color, and the tendency for improper toner deposition increases as the reflective optical density of the toner image already present is increased. The result of these characteristics is that it is very difficult to obtain color reproduction of satisfactory quality.

These difficulties have been lessened to some degree by the use of the techniques and materials disclosed in U.S. Pat. No. 3,060,020 which is herein incorporated by reference. Essentially therein disclosed is a technique utilizing toner chiefly consisting of photoconductive zinc oxide powder in order to provide appropriate photoconductive property to the toner image. This technique may be more fully understood by reference to FIGS. 1, 2A and 2B of the accompanying drawing in which.

Figure 1:
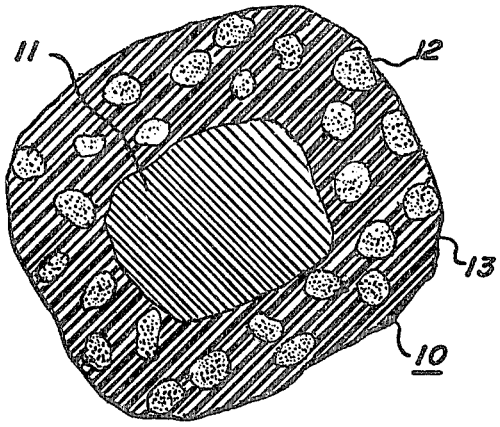
FIG. 1 is an enlarged cross section of the toner particles.

In FIG. 1, toner particle 10 consists of core 11 composed of photoconductive zinc oxide particle surrounded by a colored resin layer 13, which may be composed either of pigment particles 12 dispersed in resin as shown or of resin colored with an appropriate dye. The resin 13 is required to be liquified by heat, and the melting point thereof is usually required to lie between about 90 and about 250° C. In addition, the resin layer is required to be highly insulting and to have sufficient capability to generate favorable frictional electricity (i. e. a capability to generate sufficiently strong positive charge if the latent image is negative). Furthermore the resin 13, when melted, should be of sufficiently low viscosity, preferably between about 45 and about 10,000 centipoises, so as to be removed from the surface of the zinc oxide core.

Figure 2A:
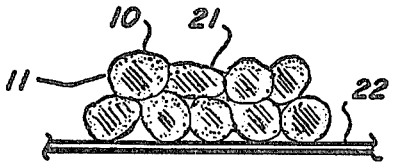
FIG. 2A is an enlarged cross section of a toner image on an imaging surface.
Figure 2B:
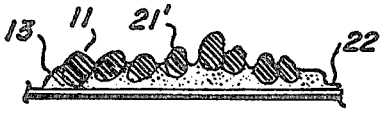
FIG. 2B is an enlarged cross section of a fused toner image on an imaging surface.

FIGS. 2A and 2B show the method of using the dry powder toner described in said U.S. Patent in a dry development system. As shown in FIG. 2A, the toner image 21 is formed by toner particles 10 held onto the imaging surface 22 bearing an electrostatic latent image. The toner layer thus formed simply by means of electrostatic forces of attraction does not possess photoconductivity due to the high electric resistance of resin layer 13 surrounding the zinc oxide core 11. When the toner is melted by heat as shown in FIG. 2B, the resin 13 together with pigment 12 is spread onto the imaging surface thereby exposing the surface of zinc oxide core particle. As a result, the fixed toner layer 21' shown in FIG. 2B acquires photoconductive property on account of the exposed zinc oxide particles 11.

This process, however, has several drawbacks among which are the fact that the heating up to 90–250° C. required for melting the toner image may cause irreversible dilatation of the imaging surface which may result in the formation of unsatisfactory prints due to imperfect registration during the second and third imaging sequences. This difficulty is especially pronounced when the support material consists of paper, as for example in Electrofax paper. In addition, the colors obtained by this process are not of high saturation but rather become whitish since the white zinc oxide powder is almost exposed to the surface after fixing of the toner image by heat. This difficulty results in impure color or lack of color density when three color images are superimposed one upon the other. The melting point and limited viscosity range of the resin seriously confine the selection of suitable materials to only certain types which also must be highly insulating and capable of being triboelectrically charged to a suitable polarity and potential. Furthermore, this dry developer toner cannot be used with a particle size smaller than a certain limit, and therefore is not capable of providing high resolution and satisfactory tone reproduction. Actually, the toner is frequently composed of aggregates of several to several tens of zinc oxide particles instead of being composed of a single particle as shown in the ideal case of FIG. 1.

SUMMARY OF THE INVENTION

It is therefore an object of this invention to provide a novel liquid developer.

It is another object of this invention to provide a novel liquid developer for use in color electrophotography with multiple development.

It is another object of this invention to provide a liquid developer containing photoconductive particles.

It is another object of this invention to provide a novel imaging system.

It is another object of this invention to provide an imaging system capable of high resolution and high color density.

It is another object of this invention to provide a color electrophotographic process with multiple development wherein the toner particles do not have to be fused to the imaging surface.

The above objects and others are accomplished generally speaking by providing an imaging system employing a liquid developer comprising a suspension in an insulating liquid of colored particles and white or dye sensitized photoconductive particles preferably in the presence of a dissolved or dispersed resin or oil for regulating the electrostatic charge or for stabilizing the suspension. In the liquid development technique with multiple development the surface bearing the electrostatic latent image after the development step of the first imaging sequence has been completed is subjected before contacting with the developer of the next imaging sequence to a step of pre-bathing in which said image bearing surface is brought into contact with a highly insulating liquid not containing toner in order to neutralize the electrostatic charge remaining in the toner layer from the development step of the previous imaging sequence to thereby prevent fogging of the several toner images. The pre-bathing step may be accomplished immediately after the development step or it may be accomplished prior to the development step in the second and third imaging sequences or it may be accomplished prior to the second and third exposure steps.

Figure 3:
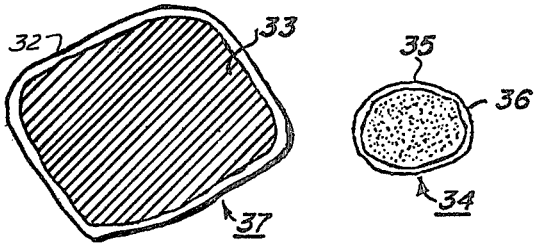
Figure 4:
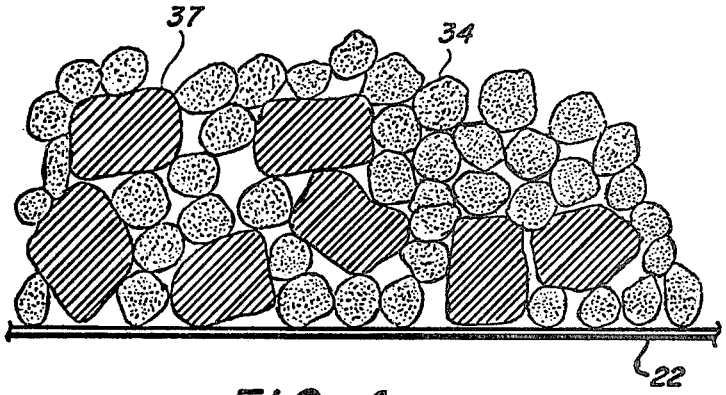
Figure 5:
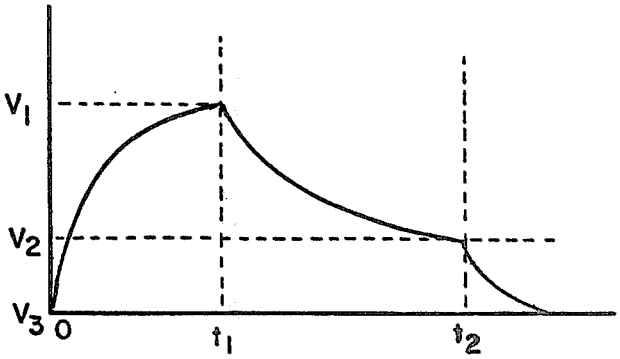

The invention may be more fully understood by reference to FIGS. 3, 4 and 5 of the accompanying drawing in which:

FIG. 3 is an enlarged cross section of the toner and photoconductive particles of this invention.

FIG. 4 is a cross section of a developed image formed by development with the liquid developer of this invention.

FIG. 5 is a graph showing the change in electrostatic charge on the toner image of FIG. 2.

The developer of this invention comprises toner particles and photoconductive particles suspended in an insulating liquid.

The solids of the developer, generally represented in cross section in FIG. 3, comprise photoconductive particle 37, preferably consisting of particulate photoconductive material 33 and thin layer of resin 32 absorbed therearound.

The resin layer 32 is required to be as thin as possible to facilitate adequate exposure of photoconductive material 33 to dissipate any charge thereon. Otherwise, it would be necessary to employ some means to remove the resin layer to expose photoconductive particle 33. As disclosed in the following examples to provide adequate exposure, the resin covering the photoconductive particles is preferably soluble in the carrier liquid of the liquid developer. The resin layer may be employed in any suitable amount. Typically, the dispersed particle usually contains not more than about 2 parts by weight of the resin in 100 parts of particulate photoconductive material. The photoconductive properties of the particle are hardly affected by the presence of this amount of resin and the electrostatic charge on the developed toner layer containing said particles is capable of being completely neutralized without the troublesome additional steps of removing the resin layer as indicated in the aforementioned U.S. Patent. Any suitable resin may be employed to provide a thin layer on a suitable particulate photoconductive material. Typical well known particulate photoconductive materials include zinc oxide, zinc sulfide, cadmium sulfide, zinc selenide, cadmium selenide, titanium dioxide, zinc cadmium sulfide, zinc magnesium oxide, phthalocyanine, and polyvinyl carbazole. Typical resins that may be employed to provide the resin layer include epoxy ester resin, silicone resin, alkyd resin, phenol-formaldehyde resin, xylen-formaldehyde resin etc.

Toner particle 34, composed of colored particle 36 and preferably having a layer of a resin 35 absorbed therearound, determines the color of the developed image, and provides higher saturation of color as the diameter thereof decreases. The color of the developed toner image also acquires higher saturation as the amount of particles 34 increases with respect to that of particles 37 but the photoconductive property of toner layer is simultaneously deteriorated to provide satisfactory balance between color and photoconductivity the ratio between the amounts of particles 37 and particles 34 should be controlled within a suitable range. Although this range is dependent to some extent on the sizes of both particles, typically from about 5 to about 104 parts by weight of photoconductive particles 37 are used for every 100 parts by weight of toner particles 34, for typical particle sizes of particles 37 and 34 of from about 0.1 to about 1micron and from about 0.01 to about 0.5 micron respectively. The toner particle 34 may comprise any suitable colorant from the group of well known dyes and pigments. Typically in multiple development color electrophotography three liquid developers are provided each one containing one of the three subtractive primaries yellow, magenta and cyan. Typical well known specific colorants lacking photoconductive properties include benzidine yellow, carmine, millory blue, rhodamine, titanium yellow and Hansa yellow. When the colorant is an organic dye it is preferably insoluble in the carrier liquid and since the specific gravities of usual organic dyes and typical photoconductors such as zinc oxide are from about 1.5 to about 2 and about 5.6 respectively, the above weight ratio can be converted into 1.3–3500 parts by volume of zinc oxide particles 33 with respect to 100 parts by volume of dye particles 36, with the amount of resin 32 and 35 around the core particles 33 and 36 being neglected. Zinc oxide present in excess of this range will result in unfavorable color reproduction whereas the toner layer will show insufficient photoconductivity if the amount of zinc oxide does not reach this range.

Any suitable well known insulating liquid may be employed as the vehicle for the photoconductive particles and toner particles. Typical well known materials have volume resistivities greater than about $10^{10}$ ohm-cm so as not to affect the electrostatic charge pattern on the insulating layer and low dielectric constants of less than about 3.4. Typical specific vehicles include among others, the nonpolar hydrocarbons and hydrocarbon derivates such as benzene, kerosene, cyclohexane, toluene and carbon tetrachloride.

In FIG. 2A, the toner layer shows high electric resistance as the layer is composed of toner particles 10 electrically insulated from each other, whereas in FIG. 4 the electric carrier formed by the effect of light in the photoconductive particles 37 can easily unite with ions on toner particles present in the proximity of said particles 37 due to the uniform distribution of photoconductive particles 37 and toner particles 34 and the smaller distance between said photoconductive particles 37. Consequently, in the process of this invention, it is completely unnecessary to melt the toner layer by heat to expose the photoconductive particles. The present invention differs from the technique described with respect to FIGS. 1 and 2 in that the electrostatic charge remaining on the developed toner layer can be completely neutralized prior to development in the second or third development step simply by contacting said layer with an insulating liquid. In the liquid development technique with multiple development the image bearing surface after the first development step has been completed is subjected before contacting with the developer of the next development step to a step of pre-bathing in which said surface is brought into contact with a highly insulating liquid not containing toner in order to neutralize the electrostatic charge still remaining in the toner layer from the previous development sequence. The sequence of steps in this multiple development technique may include initial charging and exposure of the photoconductor through a suitable first filter followed by development with the appropriately colored liquid developer of this invention. The photoconductor with the first developed toner image thereon is subjected to the pre-bathing technique of this invention prior to the second imaging sequence comprising charging, exposing through an appropriate filter and developing with the corresponding colored liquid developer. After this second development sequence the photoconductor bearing the first and second deveoped toner image is subjected to an additional pre-bathing technique prior to the development step of the third imaging sequence. While the above technique describes the pre-bathing step as the initial step in the second and third imaging sequence, it is necessary only that the photoconductor be subjected to the pre-bathing technique prior to the development step in the second and third imaging sequence. In this manner, any residual charge remaining on the imaging surface from a prior imaging sequence is effectively neutralized prior to subsequent deposition of toner in response to an electrostatic charge pattern. Therefore, toner is electrostatically attracted to only the image areas produced in each imaging sequence and is not deposited on the photoconductor in response to more than one or overlapping image areas of several imaging sequences. To provide this result, the photoconductor may be subjected to the pre-bathing treatment prior to charging, exposure or development in the second and third imaging sequence.

During uniform electrostatic charging in the dark the zinc oxide photosensitive paper as shown in the toner layer depicted in FIG. 4 is electrostatically charged by the adsorption of ions. As shown in FIG. 5, the surface potential of toner layer reaches $V_1$ by means of electrostatic charging such as by corona discharge carried out for a period between time O and $t_1$ in the dark, and then decreases to $V_2$ by interrupting said charging at time $t_1$ and effecting imagewise exposure from the time $t_1$ and $t_2$. The proportion of photoconductive particles 37 is preferably as small as possible since a larger proportion thereof will inevitably result in the deterioration of color quality although a larger portion will enable the attainment of a lower value of $V_2$ against a determined amount of light of exposure. Successively the surface potential can be rapidly reduced to zero by bringing the toner image into contact with the pre-bath liquid. This neutralization of surface potential by pre-bath step provides a great advantage of this invention in comparison with the process of aforesaid U.S. Patent. The neutralization by means of the pre-bath step can be explained by the formation of ions by the triboelectric contact between the particles and pre-bath liquid, and also by the fact that the liquid filling the gap between the particles give mobility to the ions.

An additional advantage of this invention lies in the fact that the ratio between the amounts of pigment particles 34 and photoconductive particles 37 can be arbitrarily varied during or prior to use of the developer, whereas in the process disclosed in U.S. Patent this ratio is fixed when the developer is prepared. When reproducing colored positive image from a colored positive original pattern onto a panchromatically sensitized photosensitive layer by means of the multiple development process, it is necessary to select the order of development in order to minimize the effect of undesirable spectral absorption of available dyes or pigments of cyan, magenta and yellow. Since these dyes and pigments generally show undesirable spectral absorption in the shorter wavelength side with respect to the main absorption region thereof, it is preferred to provide development in the order of shorter to longer wavelength region with respect to the main absorption of these dyes or pigments, namely in the order of yellow, magenta and cyan successively. At this point it is to be noted that yellow-colored dyes or pigments generally have tendency to show relatively high retentive potential. Consequently, the process of this invention is particularly effective when applied in the liquid developer containing yellow dye or pigment, and is capable of providing almost ideal color reproduction.

DESCRIPTION OF PREFERRED EMBODIMENTS

The following preferred examples further define, describe and compare preferred materials, methods and techniques of the present invention. In the examples, all parts and percentages are by weight unless otherwise specified.

EXAMPLE I

A yellow developer is prepared by dispersing the following material by means of ultrasonic wave of 29 KC and 150 W to produce Solution A.

| | |
|---|---|
| Benzidine yellow | 0.4 parts by weight |
| Styrenated-alkyd resin | 0.5 parts by weight |
| Linseed oil | 0.1 parts by weight |
| Cyclohexane | 400.0 parts by weight |
| Kerosene | 100.0 parts by weight |

The following materials are dispersed by means of ultrasonic wave of 29 KC and 150 W to form Solution B:

| | |
|---|---|
| Photoconductive zinc oxide | 0.1 part by weight |
| Styrenated-alkyd resin | 0.5 part by weight |
| Linseed oil | 0.1 part by weight |
| Cyclohexane | 400.0 parts by weight |
| Kerosene | 100.0 parts by weight |

The developer of this invention may be prepared by mixing Solution A and Solution B in a suitable ratio. The following table shows the values of $V_1$ and $V_2$ for various mixing ratios, wherein $t_1$ and $t_2$ are 10 and 20 seconds respectively, and the photosensitive material is exposed to white light of 400 lux at $1=t_1$ and is brought into contact with kerosene at $t=t_2$.

| No. | 1 | 2 | 3 | 4 | 5 |
|---|---|---|---|---|---|
| Solution A | 100CC | 50 | 30 | 25 | 20 |
| Solution B | 0CC | 50 | 70 | 75 | 80 |
| $V_1$ | 27V | 35 | 32 | 25 | 20 |
| $V_2$ | 25V | 25 | 19 | 13 | 13 |
| $V_3$ | 7V | 0 | 0 | 0 | 0 |

As can be seen from the above table, the value of $V_3$ remains at 7 volts when photoconductive particles are not dispersed in the developer, leading to impure color due to the improper attraction of other toner in the succeeding development to these charged toner areas.

On the other hand, the presence of photoconductive particles in an appropriate amount effectively reduces the value of $V_3$ to zero, and still the whitening of the yellow image obtained due to the adhering of the white zinc oxide particles is hardly observable in the images developed with the developers 2 through 5.

Although the Solution A and Solution B are prepared in diluted state at first in this example, it is also possible to prepare the developer by preparing a paste with linseed oil, zinc oxide powder and resin and then dispersing the paste into dispersion media such as cyclohexane or kerosene directly prior to use.

EXAMPLE II

The following materials are blended in a ball mill for one hour to give Paste A:

| | |
|---|---|
| Brilliant carmine 6B | 30 parts by weight |
| Varnish obtained by heating 1:1 mixture of linseed oil and rosin denatured phenol-formaldehyde resin | 60 parts by weight |

-continued

| | |
|---|---|
| Linseed oil | 10 parts by weight |

In a similar manner, Paste B is prepared of the following materials:

| | |
|---|---|
| Photoconductive zinc oxide | 20 parts by weight |
| Varnish | 60 parts by weight |
| Linseed oil | 20 parts by weight |

A developer obtained by dispersing about 1 gram of Paste A in 800 CC of cyclohexane and 200 CC of kerosene provides a developed toner image having a reflective optical density of about 2.0 and $V_1$ and $V_3$ are found to be 8 and 3 volts respectively. On the other hand, $V_3$ is found to be zero in the toner images developed in the same manner with a developer obtained by dispersing from about 0.1 to about 2.0 g of Paste B into the above-mentioned developer. The whitening of obtained image due to dispersed zinc oxide powder is hardly observable.

EXAMPLE III

A cyan developer is prepared by blending the following materials in a ball mill for one hour to form Paste A:

| | |
|---|---|
| Millory blue | 40 parts by weight |
| Varnish | 50 parts by weight |
| Linseed oil | 10 parts by weight |

Paste B is also prepared similarly from the following materials:

| | |
|---|---|
| Photoconductive zinc oxide | 20 parts by weight |
| Varnish | 60 parts by weight |
| Linseed oil | 20 parts by weight |

A developer prepared by dispersing 1 gram of Paste A in 800 CC of cyclohexane and 200 CC of kerosene provides a developed toner image having a reflective optical density of about 2.0 and $V_1$ and $V_3$ are found to be 3 and 2 volts respectively. On the other hand, $V_3$ is reduced to zero in similar toner images developed by developers prepared by dispersing from about 0.05 to about 2.0 g of Paste B into the above-mentioned developer.

EXAMPLE IV

A yellow developer is prepared by the procedure of Example I except that the white photoconductive zinc oxide powder in Example I is replaced by pale yellow dye-sensitized zinc oxide powder, which has been prepared by placing the zinc oxide particlces in the following composition for sufficient time to cause absorption of dye onto the zinc oxide particles.

| | |
|---|---|
| White photoconductive zinc oxide powder | 10 grams |
| Titanium yellow | 3 milligrams |
| Methanol | 40 CC |

The zinc oxide particles are then separated by filtration and dried. The sensitized zinc oxide thus obtained increases the photographic sensitivity of the developer for white light more than 10 times, exhibits a lower value of $V_2$ due to its pale yellow color, and further improves the color of toner itself. Sensitization with other sensitizing dyes can be carried out in a similar manner.

The developers disclosed in Examples I through IV are suitable for exposure with white light through a color separation negative image and are not suitable for exposure directly from the colored original through a color separation filter.

The following example provides a developer capable of use with direct exposure from a colored original through a color separation filter.

EXAMPLE V

A yellow developer is prepared by dispersing the following materials by means of ultrasonic wave for 10 minutes to obtain Solution A:

| | |
|---|---|
| Benzidine yellow | 0.4 parts by weight |
| Varnish | 0.4 parts by weight |
| Linseed oil | 0.1 parts by weight |
| Cyclohexane | 800.0 CC |
| Kerosene | 200.0 CC |

Similarly the following materials are dispersed by means of ultrasonic wave for 10 minutes to obtain Solution B:

| | |
|---|---|
| Dye-sensitized zinc oxide | 0.2 parts by weight |
| Varnish | 0.5 parts by weight |
| Linseed oil | 0.1 parts by weight |
| Cyclohexane | 800 CC |
| Kerosene | 200 CC |

The liquid developer is prepared by mixing about equal parts Solution A and Solution B. The dye sensitized zinc oxide is prepared by stirring 10 g of photoconductive white zinc oxide powder having a particle size of from about 0.1 to about 0.5 micron in a solution of the following formulation:

| | |
|---|---|
| Rhodamin B | 3 mg |
| Brilliant blue FCP | 3 mg |
| Methanol | 40 CC |

After 30 minutes the absorption of sensitizing dyes by the zinc oxide powder, is terminated by separating the zinc oxide particles by centrifuging and drying the separated zinc oxide particles. The zinc oxide particles obtained are dyed a blue color and therefore stand in a complementary relationship with yellow. Generally, if the zinc oxide is dye-sensitized for a color (generally the color of light absorbed by the colored particle) standing in complementary relationship with the color of particle (yellow in this example), then the toner image obtained by the first development shows photoconductivity against light of wavelength region employed in the second and third exposure through appropriate color separation filters. In this example, zinc oxide particles having absorbed blue dyes are capable of showing photoconductivity against green and red light.

In a similar manner, it is necessary to carry out the dye-sensitization of zinc oxide with green dye when the first development is to be effected with magenta toner, or with red dye when the first development is to be effected with cyan toner.

Furthermore, when the first and second developments are to be carried out respectively with yellow and magenta toner, then the zinc oxide contained in the second toner should be sensitized with a dye having a color capable of absorbing red light such as cyan, blue or green since the third exposure should necessarily be carried out with red light. Photoconductivity is not required for the toner used in the third development sequence.

The generalization of this Example V leads to the fact that the first color developer should be a highly insulating liquid in which are suspended particles of said first color and photoconductive zinc oxide particles sensitized with dye so as to show photoconductivity to the wavelength region of light reflected from said first colored particles and that the second color developer should be a highly insulating liquid in which suspended are particles of a second color and photoconductive zinc oxide particles sensitized with dye so as to show photoconductivity to the wavelength region of light which is reflected by both the particles of the first color and the second color.

EXAMPLE VI

A commercially available photoconductive insulating sheet comprising white zinc oxide in an insulating film forming binder on a paper backing is negatively charged in conventional manner and is exposed to a colored original through a blue filter. The electrostatic latent image is developed with the liquid developer described in Example V by immersing the zinc oxide sheet in a bath of the developer. The zinc oxide sheet is then charged in conventional manner and exposed while in registration with the position during the first exposure to the same colored original through a green filter. The zinc oxide sheet is uniformly contacted with kerosene by immersing it in a bath of kerosene. The second electrostatic latent image on the zinc oxide sheet is then developed by immersing the sheet in a bath of the liquid developer described in Example II except that the zinc oxide has been dye sensitized with brilliant green in a manner similar to the dye sensitization described in Example V. The zinc oxide sheet is again charged and exposed while in registration with the position during the first and second exposures to the same color original through a red filter. The zinc oxide sheet is then immersed in a bath of kerosene. The third electrostatic latent image on the zinc oxide sheet is then developed by contacting it with a dispersion of about one gram of Paste A of Example III in 800 cubic centimeters of cyclohexane and 200 cubic centimeters of kerosene. The resulting color reproduction when compared to the original is a faithful reproduction of the several color image areas with good color density and with substantially no background.

It is readily realized from the foregoing discussion and exemplary embodiments that the developer and processes of this invention provide superior and unique reproducing capabilities. The developers of this invention enable the reproduction of multicolor originals with exceptional accuracy and substantially no undesirable overlapping of colors by forming two or more color coded electrostatic latent images and developing the images with a developer having toner particles of complementary color. The color coded electrostatic latent images may be created by the use of color separation negative images or exposure directly through a filter and thereby enables exposure of the photoconductor to light of a selected wavelength. The development of electrostatic latent images coded in response to wavelength of light corresponding to the primary colors with the liquid developers of this invention enables the reproduction of multicolor images without the necessity of a toner fusing step and since finer size particulate material may be employed produces reproductions of superior quality.

Although specific materials and operational techniques are set forth in the above exemplary embodiments using the developer composition and development techniques of this invention, these are merely intended as illustrations of the present invention. There are other developer materials and techniques than those listed above which may be substituted for those in the examples with similar results.

Other modifications of the present invention will occur to those skilled in the art upon a reading of the present disclosure which modifications are intended to be included within the scope of this invention.

What is claimed is:

1. A liquid developer for color electrophotography with multiple development processes which comprises a carrier liquid having a dielectric constant of less than about 3.4 and a volume resistivity of greater than about $10^{10}$ ohm-cm so as not to affect an electrostatic latent image formed on an insulating layer, and dispersed in said carrier liquid, a mixture of discrete colored toner particles and discrete photoconductive particles, said colored toner particles substantially lacking the property of photoconductivity and consisting essentially of colorant selected from the group consisting of a pigment and a dye having a thin layer of a resin absorbed therearound, said photoconductive particles consisting essentially of zinc oxide having a thin layer of a resin absorbed therearound, said thin layer of said resin absorbed therearound said zinc oxide being sufficiently thin to facilitate exposure of said zinc oxide and dissipate any charge thereon, said photoconductive particles being present in an amount of from about 5 to about 104 parts by weight for every 100 parts by weight of said colored toner particles.

* * * * *